US006561719B1

(12) United States Patent
Elsaesser et al.

(10) Patent No.: US 6,561,719 B1
(45) Date of Patent: May 13, 2003

(54) SIGNAL TRANSMITTER

(75) Inventors: Heinz Elsaesser, Rietheim-Weilheim (DE); Guenter Kirn, Seitingen-Oberflacht (DE); Reinhard Mordau, Trossingen (DE)

(73) Assignee: Werma Signaltechnik GmbH & Co., Rietheim-Weilheim (DE)

( * ) Notice: Subject to any disclaimer, the term of this patent is extended or adjusted under 35 U.S.C. 154(b) by 0 days.

(21) Appl. No.: 09/743,035

(22) PCT Filed: Jun. 30, 1999

(86) PCT No.: PCT/DE99/01888

§ 371 (c)(1),
(2), (4) Date: Mar. 7, 2001

(87) PCT Pub. No.: WO00/02219

PCT Pub. Date: Jan. 13, 2000

(30) Foreign Application Priority Data

Jul. 4, 1998 (DE) ..... 198 29 971

(51) Int. Cl.[7] ..... H01H 85/00

(52) U.S. Cl. ..... 403/280; 403/281; 403/282; 403/292; 403/404

(58) Field of Search ..... 403/282, 280, 403/281, 285, 279, 278, 274, 292, 300, 312, 337, 341, 362, 379.3, 388, 404, 30, 21, 260

(56) References Cited

U.S. PATENT DOCUMENTS 4,074,941 A 2/1978 Jablonski ..... 403/260

FOREIGN PATENT DOCUMENTS

| | | |
|---|---|---|
| DE | 40 22 857 | 1/1992 |
| DE | 295 12 658 | 2/1996 |
| EP | 0 142 279 | 5/1985 |
| EP | 0 163 981 | 12/1985 |
| FR | 2 544 030 | 10/1984 |

*Primary Examiner*—Christopher J. Novosad
(74) *Attorney, Agent, or Firm*—Crowell & Moring LLP

(57) ABSTRACT

A signal generator is suggested for a mounting on holding tubes, having a base element for being placed on the holding tube and a fastening element for fixing the base element on the holding tube, which requires low expenditures during the manufacturing and ensures a reliable fixing. According to the invention, this is achieved in that the fastening element cuts form-lockingly into the material of the holding tube (4) and of the base element (1).

9 Claims, 1 Drawing Sheet

SIGNAL TRANSMITTER

BACKGROUND AND SUMMARY OF THE INVENTION

The invention relates to a signal generator for a mounting on holding tubes and, more particularly to a signal generator with a holding tube, having a base element for being placed on the holding tube and having a fastening element for fixing the base element on the holding tube.

Up to now, commercially available signal generators, for example, acoustic or visual signal generators, such as signal lights, buzzers or the like, have been provided with a base element which, for mounting on a holding tube, has a corresponding recess for it to fit onto the holding tube. For the firm fixing on the holding tube, a wedge-shaped clamping piece is laterally displaceable along the holding tube mounted in the base element. By way of a tension bolt accessible from the underside of the base element, this clamping piece is braced such that it is pressed, on the one side, against the base element and, on the other side, against the holding tube. This clamping results in a frictional engagement which causes the fixing of the base element on the holding tube.

On the one hand, such a base element requires relatively high expenditures and, if the tension bolt is not firmly tightened, leads to the risk of a loose holding.

Furthermore, for example, a multiple mounting armature is known from German Patent Document DE 295 12 658, which has a screw for the protection against torsion, by which the screwed connection is locked to a supporting tube. This requires the manufacturing of the necessary threads as well as the screwed connection of the supporting tube with the armature.

In contrast, it is an object of the invention to provide a signal generator having a holding tube and a fastening element, which can be produced at lower expenditures and ensures a secure fixing on the holding tube.

Based on a signal generator of the initially mentioned type, this object is achieved by a signal generator with a holding tube, having a base element for being placed on the holding tube and having a fastening element for fixing the base element on the holding tube. The fastening element cuts form-lockingly into the material of the holding tube and of the base element. The material of the fastening element, at least in its cutting-in area, is harder than the material of the holding tube. A recess, which, on the interior side, is open with respect to the holding tube, is provided for receiving the fastening element in the base, at least one sealing element existing for the watertight closure of the base element with respect to the holding tube.

Correspondingly, a signal generator according to the invention is characterized in that a fastening element is provided which cuts form-lockingly into the material of the holding tube and into the material of the base element. As a result of the cutting into the material during the mounting, neither the holding tube nor the base element need to have a special construction for establishing the form closure. As a result, the manufacturing expenditures are clearly reduced, in which case an extremely reliable fixing of the signal apparatus on the holding tube is ensured simultaneously.

For this purpose, the material of the fastening element is advantageously constructed to be at least partially constructed to be harder than the material of the holding tube and/or of the base element. This applies particularly in the areas of the fastening element which cut into the material, so that the cutting-in and thus the form-closure can be carried out particularly effectively.

In an advantageous further development of the invention, a recess, which, on the interior side, is bounded by the fitted-in holding tube and extends parallel to the holding tube, is provided in the base element for receiving the fastening element. In this manner, the fastening element and therefore also its areas cutting into the holding tube can extend along a certain length, so that, also when the penetration depth into the material of the holding tube or of the base element is low, a reliable holding is ensured.

In a particularly advantageous embodiment of the invention, the recess for receiving the fastening element is constructed to be accessible on the face side. As a result, the circumference-side outer wall of the base element remains unimpaired, whereby a better appearance of the base element and thus of the entire signal generator is achieved.

The recess for the fastening element is preferably constructed to be accessible from the upper face of the base element facing the signal generator. In this manner, the mounted fastening element, after the mounting of the signal generator, is arranged in the interior of the base element to be completely invisible from the outside.

In a particularly advantageous embodiment of the invention, a screw is provided as a fastening element whose thread diameter is at least partially larger than the clear measurement of the recess between the base element and the holding tube. When the screw is screwed in, which may, for example, be a conventional, commercially available sheet metal screw, the thread, on the one hand, therefore cuts into the holding tube and, on the other hand, into the base element. The manufacturing of the fastening element in this case requires no more expenditures because commercially available screws can be used. A corresponding recess must therefore be formed in the base. Since this recess can, in addition, be provided with a smooth wall, this embodiment requires minimal expenditures for fastening a signal generator.

The invention can be used in the case of holding tubes and base elements made of the most varied materials. Particularly the mounting on metallic or plastic tubes can be carried out without any problems. Likewise, the base element can consist of any material, for example, of a plastic material or of a metal.

In an advantageous embodiment of the invention, sealing elements are provided which seal off the area, in which the fastening element cuts into the holding tube, with respect to the remaining base element and thus with respect to the signal generator. This prevents an entering of water which can take place along the holding tube.

Furthermore, it is recommended to provide an insulation element in the base element by means of which a cable led to the signal generator in the holding tube is insulated with respect to a metallic holding tube. Such an insulation element can, for example, be constructed in the form of a connection piece immersed into the holding tube. In the area of this insulation element, the covering of a cable can therefore be removed without any problems, so that only the individual leads must be guided through the base element. This facilitates the handling during the electrical connection of the signal generator, in which case the individual leads are reliably insulated by the insulation element with respect to the holding tube.

An embodiment of the invention is illustrated in the drawing and will be explained in detail in the following by means of the FIGURE.

BRIEF DESCRIPTION OF THE DRAWING

The single FIGURE is a detailed sectional view of a base element for a signal generator according to the invention.

DETAILED DESCRIPTION OF THE DRAWING

Figure 1:
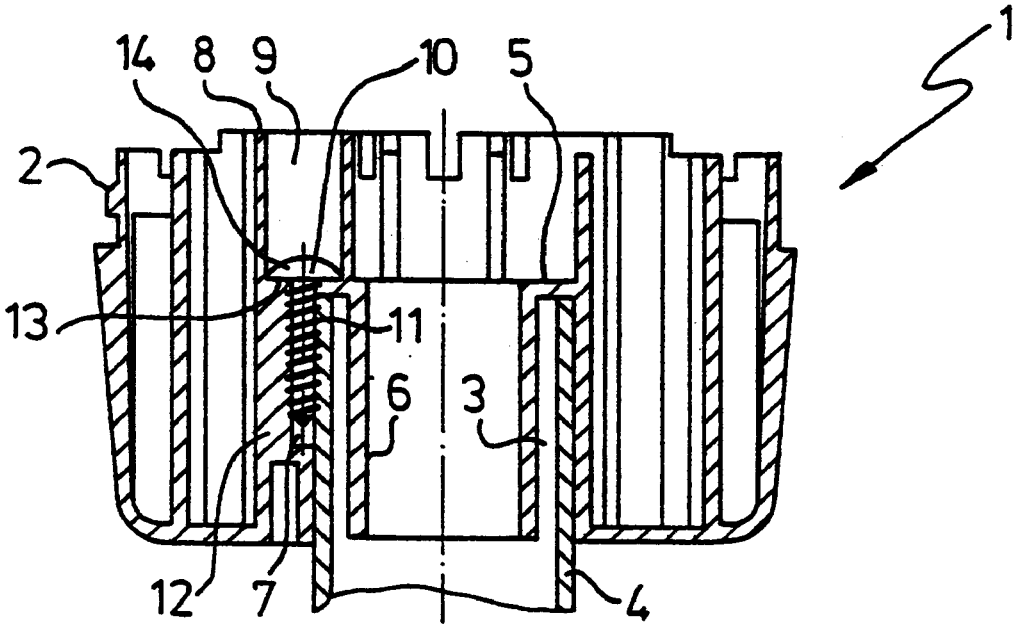

According to the FIGURE, a signal generator element, such as a light part, which is not shown in detail, is to be fitted from above onto the base (1), which light part locks with the detent (2). The base has a recess (3) into which a holding tube (4) is introduced up to the stop (5). A connection piece (6) is introduced into the holding tube (4) and therefore, on the one hand, provides a certain guidance during the fitting-on of the base and, on the other hand, as required, provides a support for the tube (4) from the interior side. In addition, the connection piece (6) insulates possible bared cable areas of a cable fed through the holding tube. The covering insulation is frequently removed from such cable in the end area, so that only the individual leads are introduced into the signal generator. When the cable with its covering is fitted into the connection piece (6), the leads situated in the interior of the connection piece (6) are additionally insulated with respect to the holding tube (4).

A recess (7) extends parallel to the holding tube (4) in the base (1) and is open with respect to the holding tube (4). The recess (7) is accessible from the upper face (8) by way of a passage (9) of a larger diameter than the recess (7).

A sheet metal screw (10) is screwed into the recess (7), the diameter of the thread (11) being larger than the clearance between the base area (12) and the holding tube (4) in the recess (7). As a result, the thread (11), on the one hand, cuts into the base area (12) and, on the other hand, into the holding tube (4). The ring shoulder (13) at the transition of the passage (9) into the recess (7) is used as a stop for the screw head (14). When the screw head (14) rests on the ring shoulder (13), the recess (7) is, in addition, closed in a watertight manner with respect to the base element (1) and thus with respect to the signal generator.

The illustrated fastening causes minimal expenditures during the manufacturing. Only the recess (7) as well as the passage (9) have to be provided in the base (1). The sheet metal screw (10) is commercially obtainable as extremely cost-effective production merchandise. The thread (11) cuts the necessary counterthread during the screwing into the holding tube (4) as well as into the base area (12). This results in an interlocked form closure between the screw (10) and the holding tube (4) and the base area (12). This ensures a reliable fixing of the base (12) on the holding tube (4).

In this case, the screw (10) must not even be firmly tightened. For fixing the base (1) on the holding tube (4), it is basically also not required that the screw head (14) rests on the ring shoulder (13). The fixing according to the invention can also easily be achieved by means of a so-called stud screw and a reduced passage (9). The illustrated embodiment with the ring shoulder (13) limits only the screw-in depth of the screw (10), whereby a good accessibility can be achieved from the face (8) for opening up the connection.

The fixing according to the invention can be released at any time and can be reestablished by screwing in the screw (10). If the counterthread cut into the metal tube (4), after having been used repeatedly, should no longer offer a sufficient hold, by means of a simple turning of the base, a section of the holding tube (4), which so far had been unimpaired, is used for the refixing.

APPENDIX OF TERMS

1 Base
2 detent
3 recess
4 holding tube
5 stop
6 connection piece
7 recess
8 face
9 passage
10 sheet metal screw
11 thread
12 base area
13 ring shoulder
14 screw head

What is claimed is:

1. A signal generator base, comprising:

a holding tube;

a base element arranged on the holding tube, the base element having a recess extending parallel to the holding tube and being open on an interior side facing the holding tube;

a fastening element having a threaded area, the fastening element being received in the recess so as to cut form-lockingly into the holding tube and the base element, wherein a material of the fastening element, at least in the threaded area is harder than a material of the holding tube, and further wherein a diameter of the threaded-area of the fastening element is at least partially larger than a clear measurement of the recess between the holding tube and the base element; and at least one sealing element sealing between the base element and the holding tube.

2. The signal generator base according to claim 1, wherein the recess is accessible on a face side of the base element.

3. The signal generator base according to claim 1, wherein the recess is accessible from a face of the base element facing a signal generator.

4. The signal generator base according to claim 1, wherein the fastening element is a screw.

5. The signal generator base according to claim 1, wherein the fastening element is a screw screwed into the recess parallel to the holding tube.

6. The signal generator base according claim 1, wherein an insulation element is provided for insulating bared cable areas on the base element.

7. The signal generator base according to claim 1, wherein the holding tube has a smooth outer surface in an area engageable with the threaded area of the fastening element.

8. A signal generator, comprising:

a base element;

a signal element coupled to the base element;

a holding tube on which is arranged the base element;

wherein the base element has a recess extending parallel to the holding tube and being open on an interior side facing the holding tube;

a fastening element having a threaded area, the fastening element being received in the recess so as to cut form-lockingly into the holding tube and the base element, wherein a material of the fastening element, at least in the threaded area is harder than a material of the holding tube, and further wherein a diameter of the threaded-area of the fastening element is at least partially larger than a clear measurement of the recess between the holding tube and the base element; and at least one sealing element sealing between the base element and the holding tube.

9. The signal generator according to claim 8, wherein the holding tube has a smooth outer surface in an area engageable with the threaded area of the fastening element.

* * * * *